US005167455A

United States Patent [19]

Forman

[11] Patent Number: 5,167,455

[45] Date of Patent: Dec. 1, 1992

[54] CONTAINER

[76] Inventor: Harold Forman, 251 W. Kalb Pk., King of Prussia, Pa. 19046

[21] Appl. No.: 689,260

[22] PCT Filed: Aug. 24, 1990

[86] PCT No.: PCT/GB90/01317

§ 371 Date: Jun. 28, 1991

§ 102(e) Date: Jun. 28, 1991

[87] PCT Pub. No.: WO91/03403

PCT Pub. Date: Mar. 21, 1991

[30] Foreign Application Priority Data

Aug. 31, 1989 [GB] United Kingdom ..... 8919666.1

[51] Int. Cl.[5] ..... B65D 33/16

[52] U.S. Cl. ..... 383/66; 383/211

[58] Field of Search ..... 383/66, 903, 203, 204, 383/211

[56] References Cited

U.S. PATENT DOCUMENTS

| | | | |
|---|---|---|---|
| 1,944,621 | 1/1934 | Atta | 383/903 |
| 2,340,651 | 2/1944 | Denison | 383/66 |
| 2,745,754 | 5/1956 | Steinback | 383/66 |
| 2,923,404 | 2/1960 | Adell | 206/56 |
| 2,991,000 | 7/1961 | Spees | 229/51 |
| 3,142,437 | 7/1964 | Grant et al. | 383/903 |
| 3,372,857 | 3/1968 | Brayla | 383/903 |
| 3,426,959 | 2/1969 | Lemelson | 383/66 |
| 3,472,369 | 10/1969 | Schuster | 383/66 |
| 3,970,130 | 7/1976 | Casey | 383/903 |
| 4,326,664 | 4/1982 | Benoit et al. | 383/903 |
| 4,785,940 | 11/1988 | Wilson | 383/204 |
| 4,786,190 | 11/1988 | Van Erden et al. | 383/211 |
| 4,840,270 | 6/1989 | Caputo et al. | 383/66 |
| 4,848,575 | 7/1989 | Nakamura et al. | 383/66 |
| 4,874,096 | 10/1989 | Tessera-Chiesa | 383/66 |
| 5,007,744 | 4/1991 | Scarberry et al. | 383/66 |
| 5,029,712 | 7/1991 | O'Brien et al. | 383/203 |
| 5,030,013 | 7/1991 | Kramer | 383/904 |

FOREIGN PATENT DOCUMENTS 2345355 10/1977 France .

*Primary Examiner*—Stephen Marcus
*Assistant Examiner*—Christopher McDonald
*Attorney, Agent, or Firm*—Nixon & Vanderhye

[57] ABSTRACT

A container (1) has a flexible wall portion with one opening (2) covered by a resealable cover (3). The cover is held at its ends (5) to the wall and includes a return bend (7) to reduce the risk that sealing and opening of the bag will tear the wall portion.

11 Claims, 2 Drawing Sheets

CONTAINER

The invention relates to a container with a resealable cover and in particular to one to contain a foodstuff or the like.

A container having at least one flexible wall formed of a material such as a plastics film, an opening being present in the wall for access to the contents of the container, a cover overlying the opening, is disclosed in EP-A 0249337. The cover includes means to indicate if the contents of the container have been tampered with. It is one object of this invention to provide a container having an opening covered by a resealable cover of this type which cover can be sealed and unsealed many times without allowing the flexible wall to be damaged, e.g. torn.

According to one aspect of the invention there is provided a container having at least one flexible wall portion, an opening being present in the flexible wall portion, a cover overlying the opening, one side of the cover being in permanent sealing engagement with the underlying part of the flexible wall on one side of the opening, the opposite side of the cover being in resealable sealing engagement with the underlying part of the flexible wall on the said opposite side of the opening, restraining means being present to prevent repeated release and sealing of the cover to the flexible wall from causing damage to the flexible wall.

Preferably the opening is an elongate slit or the like in one face of the flexible container wall but stops short of the edges thereof. Typically the flexible wall of the container is formed of a plastics material prone to tearing and is usually a plastics but may be other materials. The wall may be single or multiple ply.

The restraining means is preferably provided by an increase in the effective length of an edge of the cover in the region at the end of the slit opening, where repeated release and sealing of the container is most likely to generate stresses likely to cause tears or rips in the flexible wall. Most preferably the cover is formed of a material having high resistance to tearing; an example of a suitable material is low density polyethylene. The increase in effective length can be provided by a deformation in an edge of the cover, e.g. a return indentation or the like. The cover may be made of preformed shape, e.g. by stamping or punching out from a wide length or from a length of tape.

In order that the invention may be well understood one embodiment will now be described by way of example only with reference to the accompanying diagramatic drawings, in which.

The same reference numerals are used where possible to describe the different embodiments.

Figure 1:
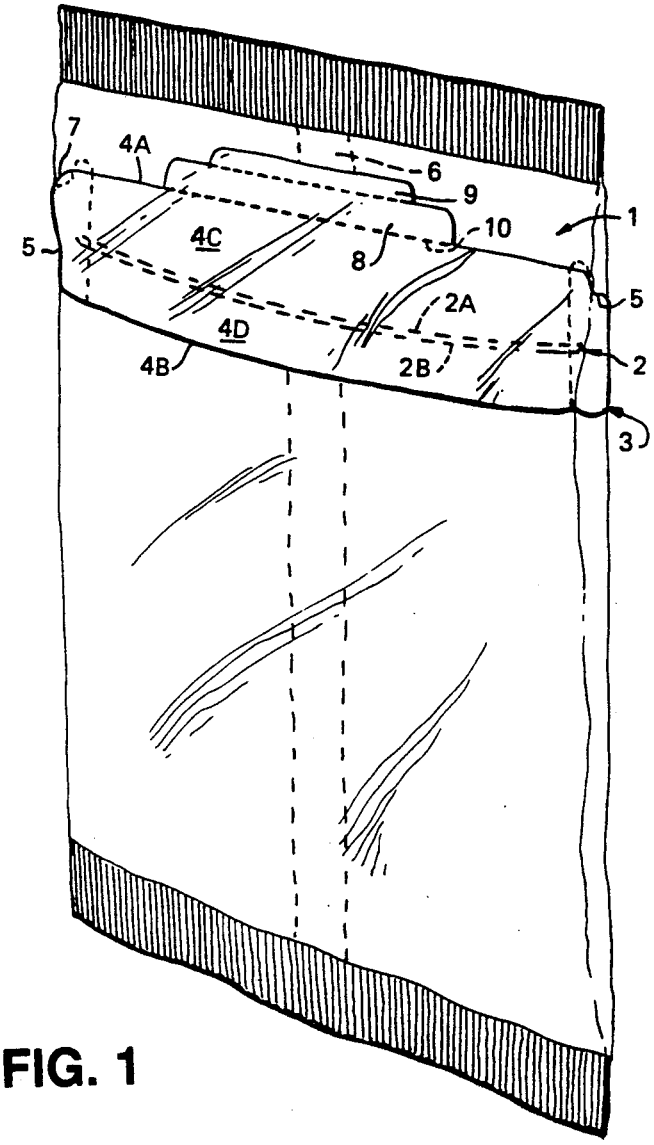
FIG. 1 is a front elevation of one bag.
Figure 2:
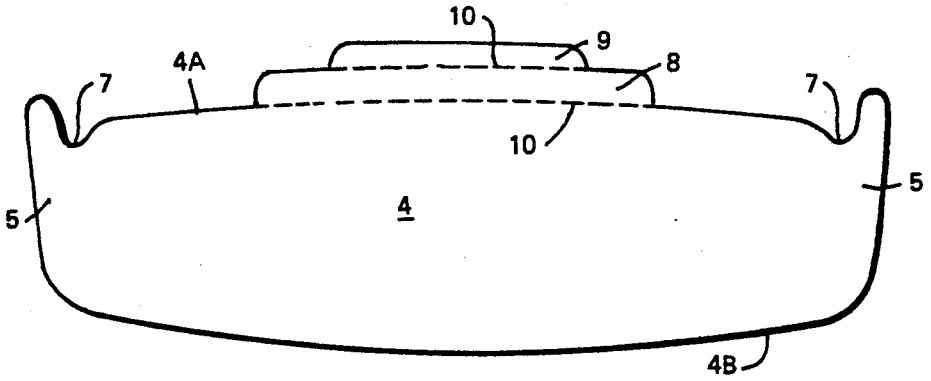
FIG. 2 is the front elevation of the cover thereof.

As shown in FIG. 1, a bag or like container of the invention is of rectangular shape as seen in plan and has a transverse slit 2 across the front face towards the top end. The length of the slit 2 is less than the width of the front face of the bag 1 by a distance of about 5 mm at each side. The slit has an upper edge 2A and a lower edge 2B. A cover 3, shown separately in FIG. 2, overlies the slit 2 and is formed of low density polyethylene film having a high tear resistance. The cover 3 has a rectangular main body portion 4 having two integral earlike side portions 5. The body portion 4 is dimensioned to be almost as wide as the width of the front face of the bag 1 and to extend perhaps 50 mm in height. The top and bottom edges 4A, 4B of the body 4 are outwardly curved, as shown. The upper part of the side portions 5 stand proud of the top edge 4A and merge therewith in a return bend 7, increasing the effective length of the edge. The top edge 4A includes a centrally located extension which comprises an adjacent strip 8 and a remote smaller strip 9. The longitudinal sides of the strip 8 are perforated at 10 for ease of tearing, as will be explained later. The underside of the cover (apart from the strip 8) has a coating of contact pressure sensitive adhesive and the cover 3 is held thereby over the slit 2. A portion of the cover directly below the strip 8 is devoid of adhesive and this "dry" area enables the user, after removing strip 8, to grip the cover in order to open the bag. When in place the body 4 of the cover 3 extends over the slit 2 and beyond the ends thereof and across the peripheral margins of the slit 2 towards the top and bottom of the bag, so sealing it all around. The portion of the body 4 above the slit edge 2A is designated 4C and the portion below the slit edge 2B is designated 4D. The cover is dimensioned so that the return 7 at each end of the body 4 is adjacent the respective end of the slit 2 and the side portion 5 extends from the front wall and is folded around to the rear wall.

The container may be made from flat film which is slit by means of a die cut and the cover or label is then applied onto the film and over the slit using conventional automatic label dispensing equipment. Both the slit and the application of the cover over the slit is accomplished while the film is flat and before it passes into the form, fill and seal (FFS) wrapper apparatus.

A bag of the invention is made from a continuous length of such flat film. The film is folded around a tubular form and the overlapping longitudinal edges are joined together, e.g. heat sealed to form a flap 6 on the rear wall. A transverse heat seal closes the bottom of the bag.

Product is then poured into the tube filling the bag. The bag is then pulled downward one bag length and is then sealed transversely sealing the top of the filled bag and the bottom of the next bag while cutting free the filled bag from the continuous length of the film.

Figure 3:
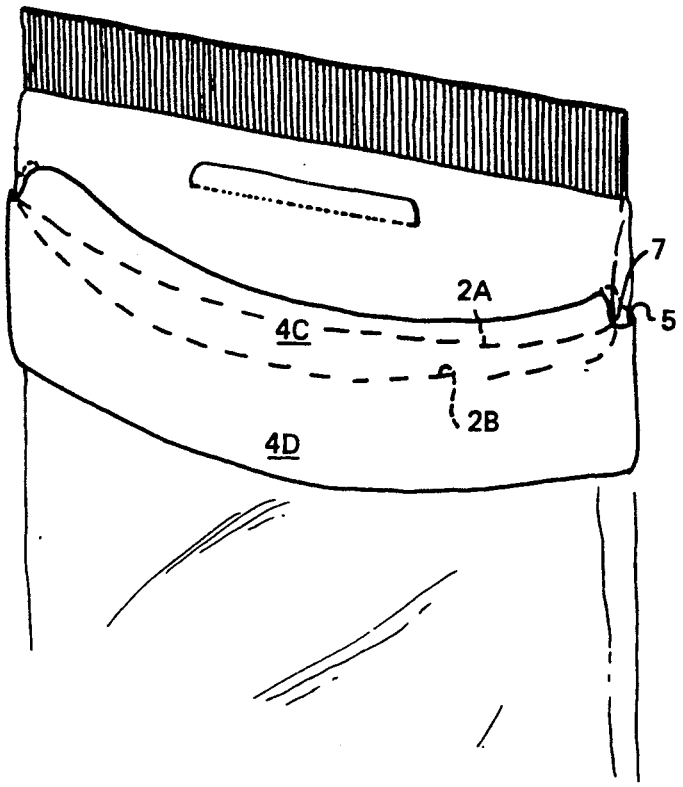
FIG. 3 is a perspective view of the top of the opened bag.

When the bag is first placed on a retail store counter, the customer can see that the bag has not been tampered with because the strip 8 is intact. When the purchaser buys the bag he can tear the strip 8 away along the perforations 10, leaving the strip 9 in place. He can then pull on the exposed edge 4A of the cover portion 4C to detach it from the underlying wall portion to gain access to the contents of the bag. The slit 2 opens, and the slit edge 2A lies against the rear wall of the bag, while the lower edge 2B is held to the underside of the cover 3 portion 4D, as shown best in FIG. 3. Contents are then removed or replaced as required. The bag is resealed by pushing the cover portion 4C back to contact the front wall of the bag and adhere to it. The wall of the bag has a tendency to tear as a result of the repeated opening and resealing but the extra length of the return bend 7 prevents stresses generated in this step from contacting the wall of the bag in any region where such stresses can do damage. Because the cover is formed of relatively tear resistant material it is able to absorb such stresses, in addition to diverting their effect by the increase in effective length. In this way, the ends of the slit 2 are shielded from the stresses induced during the unsealing step which stresses could otherwise cause the bag wall to tear.

Figure 4:
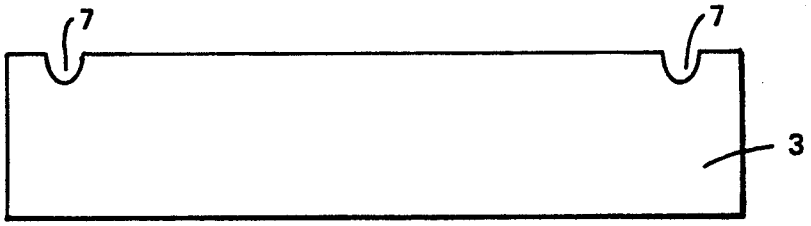
FIG. 4 is a front elevation of another cover.

FIG. 4 shows an alternative design of a cover in the form of a portion of tape which has an external means of increasing the effective length to contain stresses. The means comprises two inwardly extending edge recesses, one at each end of the length.

The invention is not limited to the embodiment shown. The bag may be of any shape, and the opening need not be a slit. The opening may extend longitudinally along the bag.

I claim:

1. A container, comprising:

at least one flexible wall portion including an underlying part and first and second side portions, and said wall further including an opening, having ends and disposed between said first and second side portions, defining an access means;

a cover for overlying the access means, includes at least first and second side portions, said first side portion of the cover being in permanent sealing engagement with the underlying part of the flexible wall on said first side portion of the flexible wall, and said second side portion of the cover being in releasable sealing engagement with the underlying part of the flexible wall opposite the said first side portion of the flexible wall; and said cover further includes ear-like portions in permanent sealing engagement with the underlying part beyond the ends of the access means, and an edge of said second side portion of the cover being joined to the ear-like portions by a return indentation.

2. A container, comprising:

at least one flexible wall including first and second underlying parts, and said flexible wall further including an opening defining an access means;

said access means being disposed between said first and second underlying parts and having at least first and second ends;

a cover overlying said access means and having first and second side portions, said first side portion being in permanent sealing engagement with the first underlying part, and said second side portion being in releasable sealing engagement with the second underlying part of the flexible wall opposite that of said first side portion;

said cover further including at least first and second end portions, each of which is disposed in a permanent engagement with the flexible wall at a location beyond each of the ends of said access means; and said end portions shield the flexible wall at the ends of the access means from stresses induced on unsealing of first and second releasable side portions of the cover with respect to the flexible wall.

3. A container according to claim 2, wherein the end portions provide an increase in the effective length of an edge of the cover at a position which in use will overlie the ends of the access means.

4. A container according to claim 2, wherein the cover is formed of a material having a high resistance to tearing, preferably a low density polyethylene.

5. A container according to claim 2, wherein means are present to provide evidence of any tampering with the cover before the container is first opened.

6. A container according to claim 3, wherein said end portions of the cover include a deformation at an edge thereof, such as a return indentation, to provide an increase in the effective length of said edge.

7. A container having a resealable cover, comprising:

a content receiving receptacle having at least one flexible wall, said wall having an opening defining an access means;

a cover for concealing said access means, said cover including an elongated central portion having top and bottom walls and first and second ends, said cover further including at least two side portions, each one of which is connected to each of said first and second ends, and at least one of said top and bottom walls and said first and second walls with said two side panels being permanently secured to said flexible wall;

said cover further includes a partial coating of a releasable securing means on an underside of said elongated central body for releasably securing the other of said one of said top and bottom walls to the container;

a tear strip is provided and disposed adjacent at least one of said top and bottom walls of the cover; and an area of said underside of the elongated central portion disposed immediately adjacent the tear strip is devoid of any coating defining a gripping means for gaining resealable access to the container.

8. A container according to claim 7, wherein said elongated central portion is curved outwardly towards the first and second ends.

9. A container according to claim 7, wherein said side portions are ear-shaped.

10. A container according to claim 7, wherein said access means is less than the width of the flexible wall.

11. A container according to claim 7, wherein said releasable securing means is a pressure sensitive adhesive.

* * * * *